United States Patent [19]

Cornelius

[11] 4,109,324

[45] Aug. 29, 1978

[54] PLASTIC WALL POOL SYSTEM

[76] Inventor: Kerry J. Cornelius, 22 Springbank Dr., St. Catherines, Ontario, Canada, L2S 2J9

[21] Appl. No.: 702,134

[22] Filed: Jul. 2, 1976

[30] Foreign Application Priority Data

Apr. 26, 1976 [CA] Canada ..... 251059

[51] Int. Cl.[2] ..... E04H 3/16; E04H 3/18

[52] U.S. Cl. ..... 4/172.19; 52/169.7

[58] Field of Search ..... 4/172, 172.19, 172.21; 52/169 R, 309, 595, 695, 758; 248/351

[56] References Cited

U.S. PATENT DOCUMENTS

| | | | |
|---|---|---|---|
| 3,458,875 | 8/1969 | Michalke | 4/172.19 |
| 3,686,694 | 8/1972 | Gerring | 4/172.19 |
| 3,720,964 | 3/1973 | Thomson | 4/172.19 |
| 3,739,539 | 5/1973 | Posnick | 4/172.19 |
| 3,975,874 | 8/1976 | Witte et al. | 4/172.19 X |
| 4,023,217 | 5/1977 | Kessler | 4/172.19 |

*Primary Examiner*—Henry K. Artis

*Attorney, Agent, or Firm*—Cushman, Darby & Cushman

[57] ABSTRACT

A plastic wall, vinyl liner pool construction has structural foam, injection moulded wall panels secured together in end to end relation. The panels are supported by hollow X-shaped braces fabricated from injection moulded structural foam which is filled with a non-compressible material such as concrete to provide a plastic shell with a solid core supporting the pool wall and a concrete deck around the perimeter of the pool. The pool wall, coping and liner are suspended from the top of the X-shaped structure.

5 Claims, 12 Drawing Figures

PLASTIC WALL POOL SYSTEM

This invention relates to swimming pool construction of the type utilizing a vinyl liner. More particularly, it relates to an improved wall construction and means for supporting it.

A swimming pool according to the invention is formed of a plurality of panels constructed of injection moulded structural foam and secured together at their end faces to form the pool outline. An improved brace member supports the wall panels in vertical orientation together with a poured concrete deck on the upper end thereof; the coping and wall liner are connected to the top of the wall panels and they, together with the panel are suspended from the brace.

According to one broad aspect, the invention relates to a plastic wall, vinyl liner swimming pool construction comprising a plurality of structural foam, injection moulded wall panels detachably connected at their ends to form the shape of the pool; a plurality of hollow X-shaped braces of injection moulded structural foam and filled with a noncompressible material, said wall panels being attached at their tops, centres and bottoms to said braces; said braces being secured at their lower ends to the perimeter pool floor by noncompressible material; a coping member secured to the upper end of said wall panels; a vinyl pool liner attached at its upper end to said coping; a concrete deck poured around the perimeter of the pool, said deck being integrated to the top of the pool wall by reinforcing means interconnecting the top of said panels and the concrete, and said wall panels, coping and liner being held in suspension by said X-shaped braces and the deck being supported thereby.

According to a further aspect the invention relates to a wall panel for use in swimming pool construction comprising, said panel being formed of injection moulded structural foam and including spaced vertically extending stiffening ribs extending outwardly at right angles from the rear face of the panel, and at least two horizontally extending ribs, one at the bottom of the panel and one adjacent the top thereof, said horizontal ribs extending outwardly at right angles from the rear face of the panel and being mutually transverse with said vertical ribs.

According to a still further aspect, the invention relates to a plastic pool wall brace comprising a pair of injection moulded, structural foam X-shaped members wherein the legs of the X are concave, and flange means on each half for abutting like flange means on the other half with means interconnecting said flanges and halves together to form hollow legs of the X-shaped brace for reception of a non-compressible material therein and ribs coplanar with and extending outwardly from said brace at the top, bottom and centre thereof for attachment of a pool wall panel to said brace.

The invention is illustrated by way of example in the accompanying drawings wherein.

Figure 1:
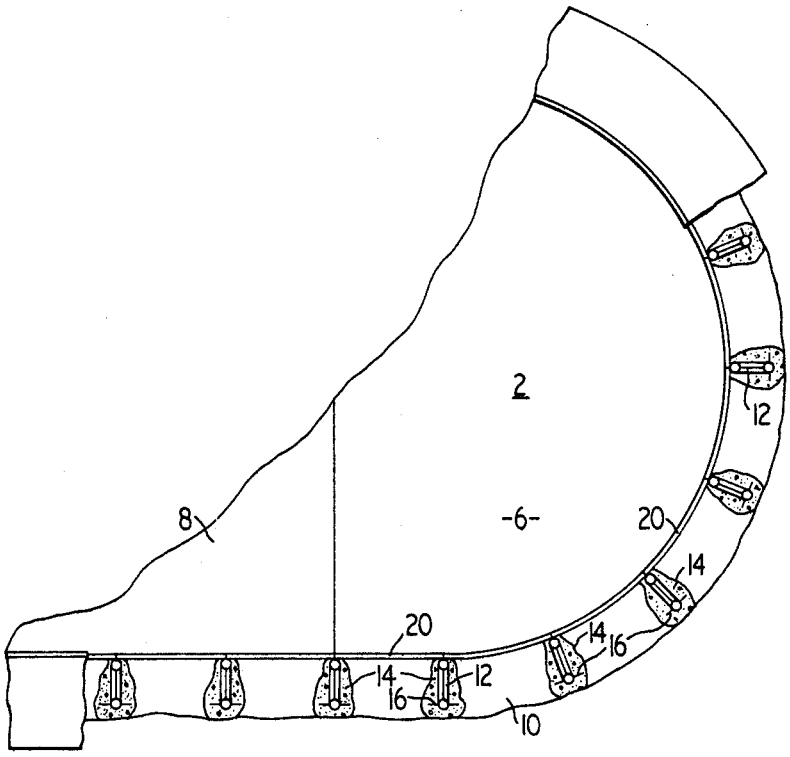
FIG. 1 is a fragmentary plan view of a swimming pool constructed according to the invention.
Figure 2:
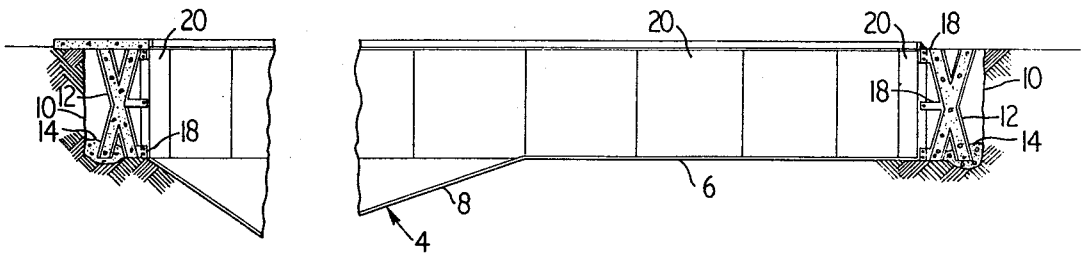
FIG. 2 is a fragmentary, partly sectioned elevation view of the pool construction of FIG. 1.

Referring to FIGS. 1 and 2 the pool assembly 2 is positioned in the well known form of excavation 4 providing flat and sloping floor portions 6 and 8 with a wide perimeter excavation 10. A plurality of spaced, X-shaped braces 12 formed of injection moulded structural foam are vertically positioned in the perimeter excavation 10 and secured in position by means of a noncompressible material such as concrete 14 with the assistance of reinforcing rods 16 extending transverse through the lower legs of the brace.

Arms 18 integrally formed with the braces extend outwardly therefrom and to these arms are connected the butting side edges of pool wall panels 20.

Figure 3:
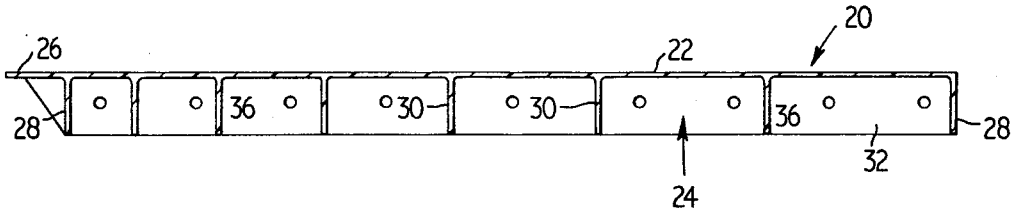
FIG. 3 is a vertical cross section of a pool wall panel.
Figure 4:
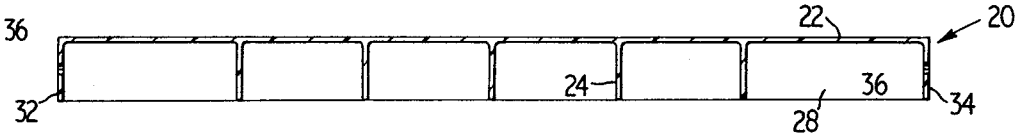
FIG. 4 is a horizontal section of the panel shown in FIG. 3.

As shown in FIG. 3, each wall panel 20 is formed of injection moulded structural foam and comprises a planar poolside face 22, which may be straight or curved in accordance with the pool configuration, and a plurality of vertical, integrally formed stiffening ribs 24 terminating short of the top of the panel leaving a flange 26 thereon. At least two horizontal ribs 28 are provided, one at the bottom of the panel 20 and one adjacent the top. If desired, additional horizontal ribs 30 may be used to increase the structural strength of the panel. As shown in FIGS. 3 and 4 all horizontal and vertical ribs extend at right angles to the face of the panel 20 and are mutually transverse to one another. The terminal side ribs 32 and 34 are provided with apertures 36 for receiving connecting bolts to secure the panels 20 to one another in end to end relation.

Figure 5:
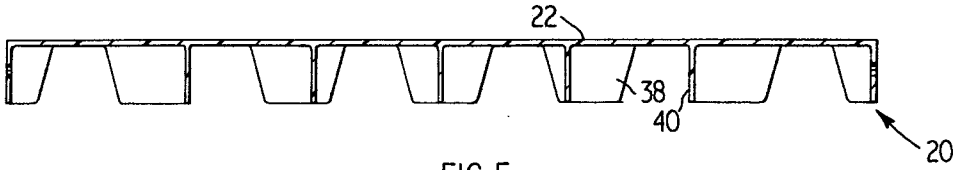
FIG. 5 is another horizontal section similar to FIG. 4 but showing an alternate form of construction.

An alternate structural form of the panel 20 is shown in FIG. 5 where short horizontal ribs 38 are used in conjunction with regular length vertical ribs 40.

Figure 6:
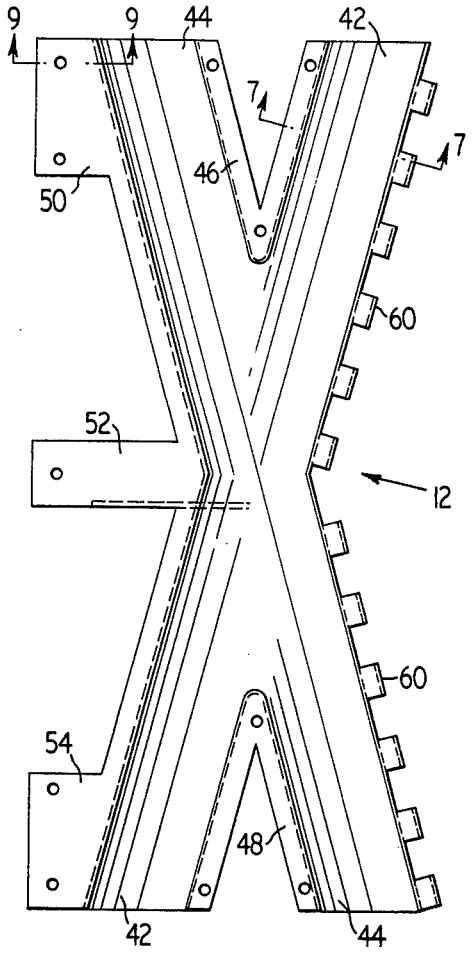
FIG. 6 is an elevation view of one half of the X-shaped brace.
Figure 9:
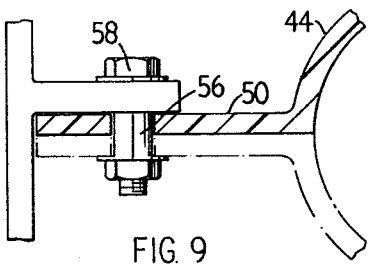
FIG. 9 is a cross-sectional view taken along the line 9—9 of FIG. 6.
Figure 10:
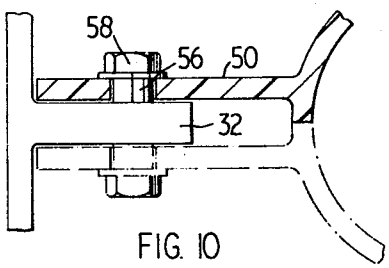
FIG. 10 is an alternate structural form of FIG. 9.
Figure 7:
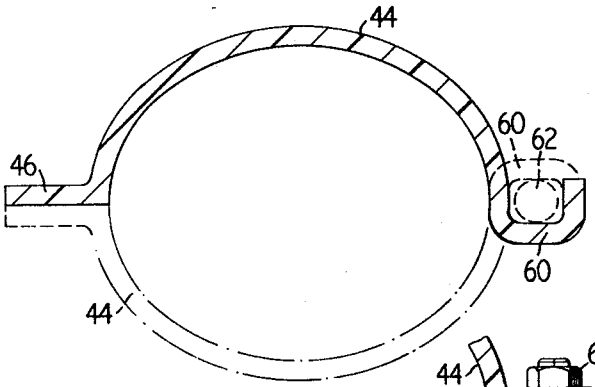
FIG. 7 is a cross-sectional view taken along the line 7—7 of FIG. 6.

Turning to FIG. 6, one half of an X-shaped brace 12 is shown and is constructed of injection moulded structural foam. The body of the X brace 12 has integrally formed legs 42 and 44 with upper and lower connecting flanges 46, 48. The legs are concave in shape as shown in FIG. 7 so that when two brace halves are joined the legs 42, 44 become tubular and hollow. The pool wall side of the brace 12, on the left in FIG. 6 includes extending arms 50, 52 and 54 for connection to the wall ribs 32 by means of apertures 56 and bolts 58 as shown in FIG. 9 or alternately in FIG. 10.

Figure 8:
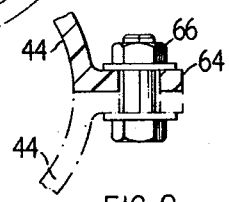
FIG. 8 is a view similar to FIG. 7 but shows an alternate form of construction.

The other side of the brace halves are preferably provided with hinge eyes 60 into which a hinge rod 62 can be inserted as shown in FIG. 7. Alternately, apertured flanges 64 and bolts 66 may be used as shown in FIG. 8.

Figure 12:
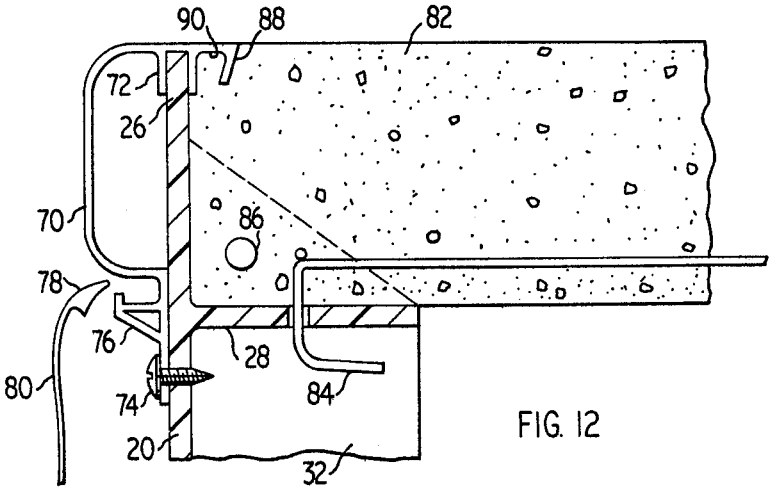
FIG. 12 is an enlarged detail in cross-section of the top of the pool wall.
Figure 11:
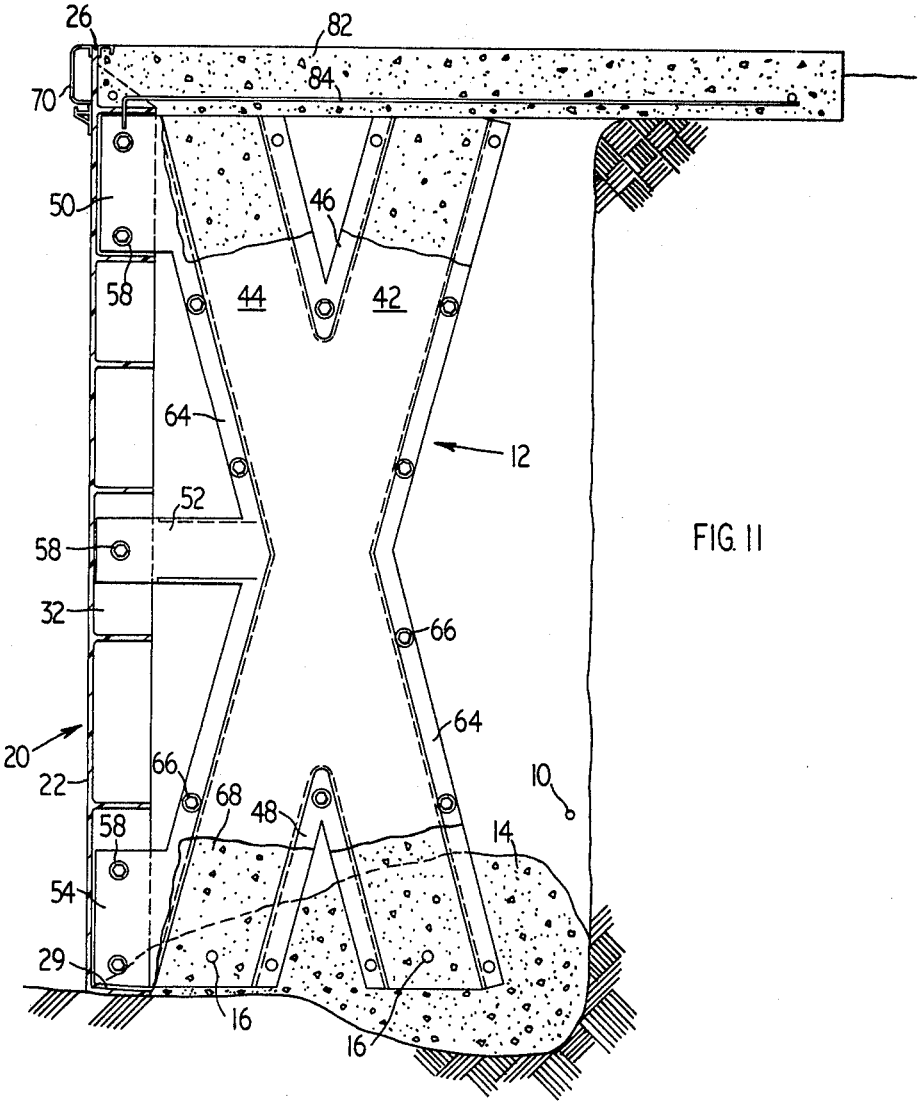
FIG. 11 is an enlarged cross-sectional view of the completed wall structure.

FIGS. 11 and 12 are sectional views of the completed pool assembly. It will be seen that the X-brace 12 is placed in a concrete footing 14 and a reinforcing rod 16 ties in the lower ends of legs 42 and 44 with the concrete. Subsequently, the wall panels 20 are connected to the brace arms 50–54 and the hollow legs 42–44 are filled with a noncompressible material such as concrete 68.

Referring to FIG. 12, a coping 70 has an integral groove 72 and the latter fits down over the flange 26 on the upper end of the wall panel 20. The lower end of the coping is fastened by self-tapping screws 74 to the upper end of panel 20 and, just above the screw, the coping has a notch 76 for receiving a fastening flange 78 on the vinyl wall liner 80.

A concrete perimeter deck 82 is then poured as shown and is interconnected with the wall 20 through reinforcing rods 84 that hook into the top horizontal rib 28 of the wall 20 and extend back through the concrete 82. Additionally, the upper end of the vertical rib 32 has a laterally extending reinforcing rod 86 therein. Lastly, the coping 70 has a depending lip 88 defining a groove 90 which engages the concrete 82 during pouring thereof.

It will be appreciated from FIG. 11 that the X-brace 12 takes the load of the deck 82 and that the wall panels 20, coping 70 and liner 80 are in effect hung or suspended from the braces 12.

The terms, expressions and the example of the invention which have been employed in the foregoing abstract and specification are used therein for purposes of description and not limitation, and there is no intention of excluding equivalents of the features shown and described or portions thereof, it being recognized that the scope of the invention is defined and limited only by the following claims.

I claim:

1. A plastic wall, vinyl liner swimming pool construction comprising:

(a) a plurality of structural foam, injection moulded wall panels detachably connected at their ends to form the shape of a pool construction, (b) a plurality of hollow X-shaped braces of injection moulded structural foam and filled with a noncompressible material, said wall panels being attached at their tops, centers and bottoms to said braces, (c) said braces being secured at their lower ends to the perimeter pool construction floor by noncompressible material, (d) a coping member secured to the upper end of said wall panels, (e) a vinyl pool liner attached at its upper end to said coping, and (f) a deck around the upper perimeter of the pool construction, (g) said wall panels, coping and liner being held in suspension by said X shaped braces and the deck being supported thereby; each said X-shaped brace comprising a pair of injection moulded, structural foam X-shaped members wherein the legs of the X are concave, and flange means on each brace half for abutting like flange means on the other brace half with means interconnecting said flanges and halves together to form hollow legs of the X-shaped brace for reception of a noncompressible material therein; and ribs coplanar with and extending outwardly from said brace at the top, bottom and center thereof for attachment of the pool wall panel to said brace.

2. The pool construction of claim 1 wherein said wall panels are formed with vertical stiffening ribs and being secured to one another by bolt means extending through terminal ribs at the sides of each panel.

3. The pool construction of claim 1 wherein said wall panels have horizontally extending stiffening ribs in addition to said vertical ribs.

4. The pool construction of claim 1 wherein the noncompressible material is concrete.

5. The pool construction of claim 1 wherein said wall panels each have a flange extending upwardly above the upper ends of said vertical stiffening members, said coping being attached to said flange.

* * * * *